US006869315B2

(12) United States Patent
Nakai et al.

(10) Patent No.: US 6,869,315 B2
(45) Date of Patent: Mar. 22, 2005

(54) JACK

(75) Inventors: Yuji Nakai, Sakai (JP); Koji Matsumoto, Ikoma (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 10/471,359

(22) PCT Filed: Apr. 14, 2003

(86) PCT No.: PCT/JP03/04756

§ 371 (c)(1),
(2), (4) Date: Oct. 23, 2003

(87) PCT Pub. No.: WO03/088428

PCT Pub. Date: Oct. 23, 2003

(65) Prior Publication Data

US 2004/0242076 A1 Dec. 2, 2004

(30) Foreign Application Priority Data

Apr. 18, 2002 (JP) ..... 2002-116190

(51) Int. Cl.[7] ..... H01R 24/04
(52) U.S. Cl. ..... 439/668
(58) Field of Search ..... 439/668, 669

(56) References Cited

U.S. PATENT DOCUMENTS 4,725,239 A * 2/1988 Shichida ..... 439/668
6,296,525 B1 * 10/2001 D'Addario et al. ..... 439/668
6,390,856 B1 * 5/2002 D'Addario et al. ..... 439/668

* cited by examiner

*Primary Examiner*—Tho D. Ta
(74) *Attorney, Agent, or Firm*—Webb Ziesenheim Logsdon Orkin & Hanson, P.C.

(57) ABSTRACT

In order to configure a jack (J) that realizes a favorable conductive state by bringing a tip electrode (10) at a front end of a plug (P) into reliable contact with a contact without making the jack bigger, a contact unit (CU) having a pair of tip contacts (CT) that contact the tip electrode (10) at the front end of the plug (P) in an embracing fashion is incorporated in a body (20). The contact unit (CU) is made of a linking portion (23), intermediate portions (24) that extend from both ends of the linking portion (23) towards an aperture side of the plug insertion hole (H), and folded portions (25) that are folded over from the ends of the intermediate portions (24) to the inner end side of the plug insertion hole (H), projecting into the plug insertion hole (H), the contact unit being formed in one piece by bending a band-shaped conductor, such as a copper alloy, and the tip contacts (CT) being formed on a free end side of the folded portions (25).

6 Claims, 9 Drawing Sheets

JACK

BACKGROUND OF THE INVENTION

1. Field of the Invention

The present invention relates to jacks that are provided with a plurality of contacts along a plug insertion hole formed in a body, the contacts including tip contacts that contact a tip electrode at a front end of a plug that is inserted onto the plug insertion hole, and intermediate contacts that contact a ring electrode at an intermediate location of the plug.

2. Description of the Related Art

Conventionally, the jacks disclosed in Japanese Patent No. 2633258 and Japanese Patent Application Publication No. JP 2001-217053A are known as jacks similar to the one disclosed in the present invention. Among these pieces of related art, the former is configured such that when a multipolar plug is inserted into a jack unit (corresponding to the body in the present invention), a conductive state is established by bringing a plurality of connection plug contacts (a concept including the tip electrode and the ring electrodes of the present invention) formed on the multipolar plug into contact with a corresponding plurality of contact terminals (corresponding to the contacts in the present invention) inside the jack unit. Moreover, the latter of these pieces of related art is configured such that the inside of a jack unit (corresponding to the body in the present invention) is provided with a ring contact piece and a tip contact piece (corresponding to the tip contact of the present invention) in which a pair of tip electrodes are formed at both ends of a plate-shaped linking member, whereby, when a unipolar plug is inserted into the jack unit, the tip electrodes at the front end of the unipolar plug are contacted in an embracing fashion by the tip contacts, and the ring electrode at an intermediate position of the unipolar plug is contacted by the ring contact piece, thereby achieving a conductive state.

Focusing on the tip contacts that contact the tip electrode at the front end of the plug, in the former of these pieces of related art (Japanese Patent 2633258), one end portion of the connection terminal disclosed in the drawings of this publication is supported by the jack unit, and the other end portion is configured with a relatively long length, so that it is used as a contact for the plug. When the connection terminal is supported in this manner, it is possible to utilize the elastic deformation of the entire material of the connection terminals, and the contact force does not decrease even when repeatedly inserting and pulling out the plug, so that a favorable performance is attained in which a contact force of substantially predetermined strength is maintained. However, if slackening or loosening occurs at the site at which the connection terminal is supported by the jack unit, then an adequate contact force may not be attained, which may lead to a bad contact, thus leaving room for improvement. To address this problem, with a jack having a structure in which a pair of tip contacts contact the tip electrodes in an embracing fashion as in the latter of the pieces of related art (JP 2001-217053A), such that the tip electrode is embraced by the pair of tip contacts, the state of the pair of tip contacts embracing the tip electrode is maintained, even when slackening or loosening of the support portion with respect to the jack unit occurs, so that a reliable contact state can be anticipated.

In these kinds of jacks, even though there is a need for forming the tip contact piece in a compact manner, in view of keeping the overall jack from becoming bigger, the tip contact piece is arranged at an end location of the jack, so that it is difficult to design a structure in which an elastic spring force is attained when used for long spans of time, thus leaving room for improvement. In particular, with a tip contact piece that is made small, as in the latter of the pieces of related art, when the tip contact piece is deformed greatly, such as when a large prying force is applied from the plug, the tip contact piece may be ultimately enter a state of plastic deformation, so that a favorable performance was difficult to realize.

It is an object of the present invention to efficiently configure a jack with which the tip electrode at the front end of a plug can be reliably contacted and a favorable conductive state established even when used over a long period of time, without making the jack bigger.

SUMMARY OF THE INVENTION

According to a first characteristic configuration of a jack according to the present invention, in a jack comprising a plurality of contacts along a plug insertion hole formed in a body, the contacts including tip contacts contacting a tip electrode at a front end of a plug that is inserted into the plug insertion hole, and intermediate contacts contacting ring electrodes and at intermediate locations of the plug, a contact unit is constituted by a linking portion that is arranged at an inner end of the plug insertion hole in an orientation perpendicular to an axis of the plug insertion hole, intermediate portions that extend from both ends of the linking portion towards an aperture side of the plug insertion hole, and folded portions that are folded over from the aperture side of the intermediate portions to the inner end side of the plug insertion hole, projecting into the plug insertion hole, the contact unit being formed in one piece by bending a conductor, and the tip contacts being formed on a free end side of the folded portions in the contact unit.

That is to say, with this configuration, if the plug is inserted into the plug insertion hole of the body, the pair of tip contacts contact the tip electrode at the front end of the plug in an embracing fashion. When the tip contacts are contacted in this manner, a contact pressure can be attained through a relatively large elastic deformation utilizing the combined regions of an elastic deformation region of the folded pieces and an elastic deformation region of the intermediate portions, and there is no risk of plastic deformation of the contact unit, even when the plug is repeatedly inserted. Furthermore, since the folded portions are formed at the intermediate portion of the contact unit by folding from the end on the side opposite the linking portion back toward the linking portion, the contact unit can be provided with substantially the same length in the direction along the axis of the plug as the intermediate portions. As a result, the size of the contact unit is small, and the overall size of the jack can be prevented from becoming bigger, while achieving a jack with which a reliable and favorable conductive state can be realized by bringing the tip at the front end into contact with the tip contacts, even when the plug is inserted repeatedly.

According to a second characteristic configuration of a jack according to the present invention, in a jack having the first characteristic configuration, the contact unit is provided with abutting portions protruding toward the folded portions or toward the tip contacts, the abutting portions being formed in one piece with the intermediate portions, and when the folded portions are elastically deformed more than a predetermined amount, the abutting portions are abutted and deformation of the folded portions is prevented.

That is to say, with this configuration, even in situations in which at least one of the folded portions is deformed considerably in the direction away from the axis of the plug insertion hole, such as when for example a prying force is applied while inserting the plug into the plug insertion hole, the folded portion or the front contact abuts against the abutting portion, thereby setting a limit to the deformation, so that excessive deformation can be avoided. As a result, the problem that the members constituting the contact unit are plastically deformed can be avoided, and a favorable contact state can be maintained over long periods of time.

According to a third characteristic configuration of a jack according to the present invention, in a jack having the first characteristic configuration, a spacing in a direction along the plug insertion hole between a conduction site of the intermediate contacts and a conduction site of the tip contacts is set to a value that is smaller than a length in a direction along a plug axis of a region of the plug's tip electrode at which conduction to the contacts is possible.

That is to say, with this configuration, by setting the length relation in this manner, when the plug is inserted into the plug insertion hole, the intermediate contacts contact the tip electrode at the front end of the plug during this insertion, establishing a conductive state, then the intermediate contacts are separated from the tip electrode, and thereafter the tip contacts contact the tip electrode. Thus, the problem does not occur that the tip electrode simultaneously contacts the intermediate contacts and the tip contacts, establishing electrical conduction between the intermediate contacts and the tip contacts. As a result, no unnecessary current will flow between the intermediate contacts and the tip contacts, for example. In particular, when headphones or earphones or the like have been connected with the plug, the problem of grating noises being generated while the plug is inserted into the jack is avoided.

According to a fourth characteristic configuration of a jack according to the present invention, in a jack having any of the first to third characteristic configurations, the intermediate contacts are arranged at an intermediate location and at a base end position that is located closer to an aperture side of the plug insertion hole than the intermediate location, such that the intermediate contacts contact the two ring electrodes formed at intermediate locations of the plug, and the intermediate contacts at the base end location are configured as a pair, arranged in opposition at locations clamping the ring electrode.

That is to say, with this configuration, it is possible to connect two ring electrodes and a tip electrode, such as in a stereo plug. Moreover, a pair of intermediate contacts are arranged at positions clamping the ring electrode on the base end side of the plug, so that when the plug is inserted into the plug insertion hole, the pair of intermediate contacts clamps the plug, and the plug's orientation is stabilized, while keeping the plug from coming out off the jack. As a result, a jack is achieved with which an inserted plug can be held reliably.

DETAILED DESCRIPTION OF THE INVENTION

Referring to the accompanying drawings, the following is an explanation of embodiments of the present invention.

Figure 1:
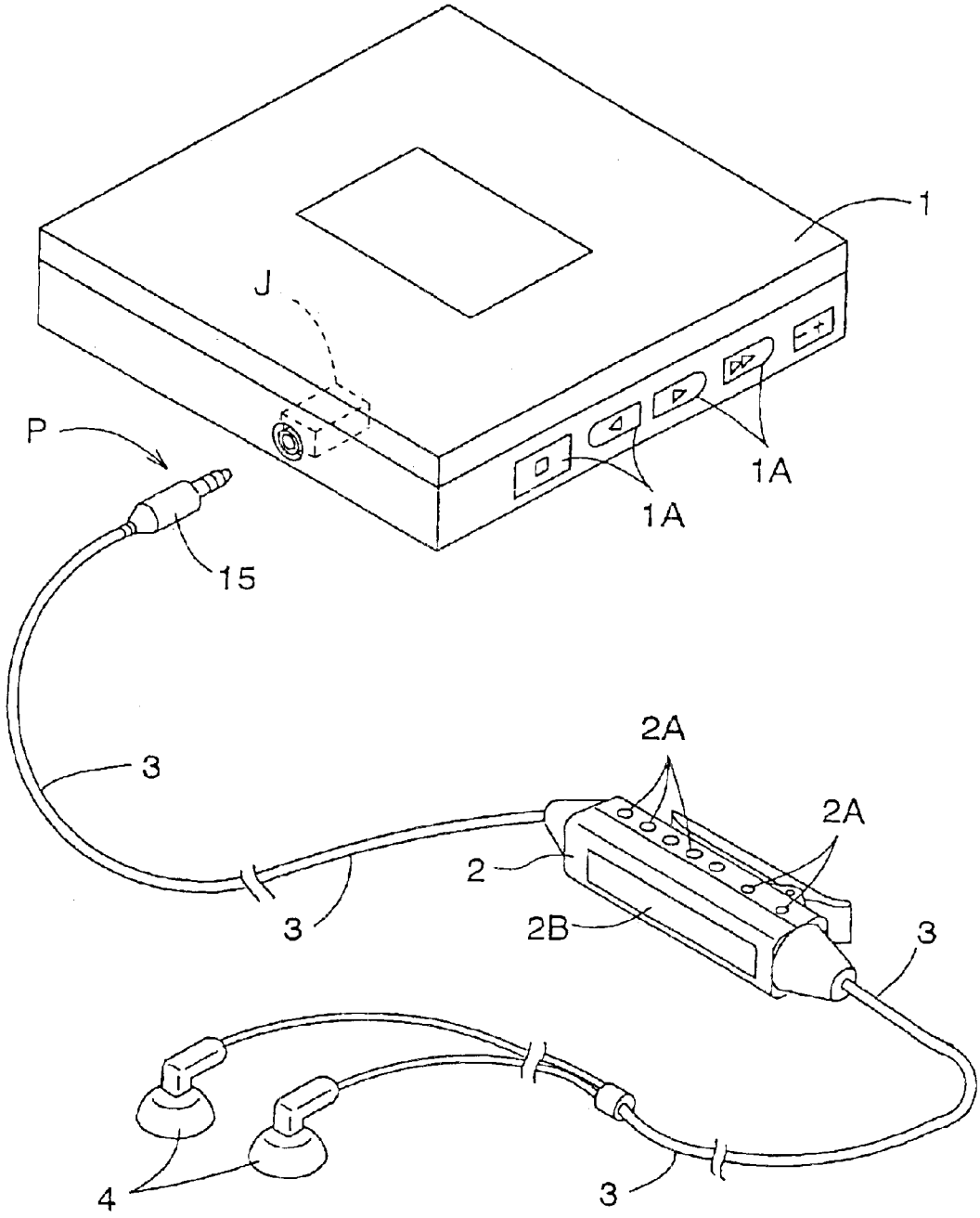
FIG. 1 is a perspective view of a plug and a jack for connecting an audio device and earphones.

A jack J in accordance with the present invention can be provided in a mobile phone or, as shown in FIG. 1, in a portable audio device 1, such as an MD player or a CD player. As shown in FIG. 1, the jack J is configured so as to allow use of a single-prong plug P for connecting stereo ear-phones 4 or headphones (not shown in the drawings) via a cable 3 that is provided with a controller 2 at an intermediate portion.

As shown in FIG. 1, when using the plug P having the controller 2, it is possible to play or stop the audio saved on a medium placed in the audio device 1 or to control the volume or the like by operating a plurality of switches 2A provided on the controller 2. If the controller 2 is provided with a liquid crystal display 2B as shown in FIG. 1, then its control state can be displayed. The jack J can also be used for an ordinary plug P that is not provided with a controller 2. When using such a plug P, it is possible to play or stop the audio or to control the volume or the like by operating a plurality of switches 1A provided on the audio device 1.

Figure 2:
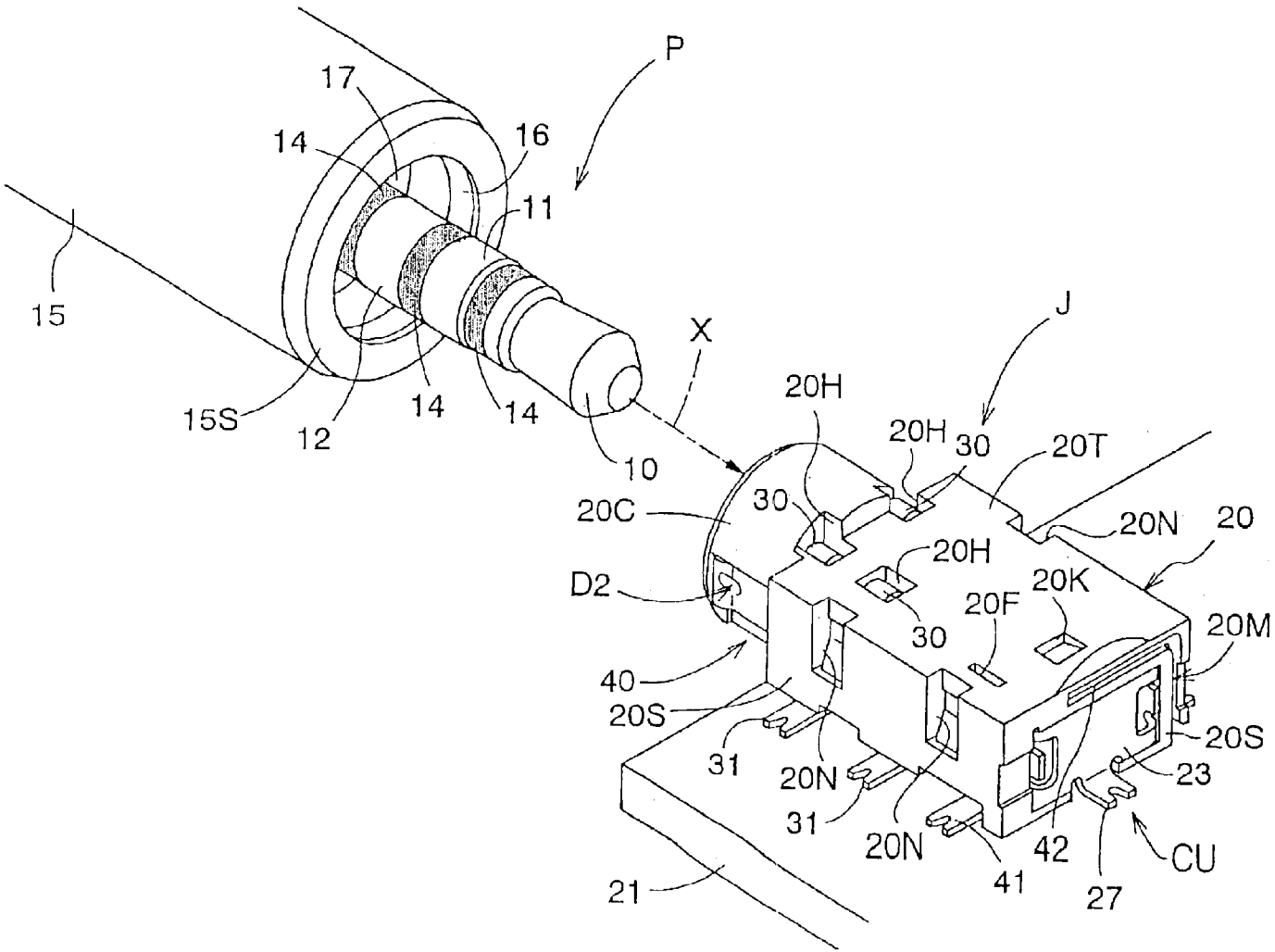
FIG. 2 is a perspective view of a plug and a jack.
Figure 9:
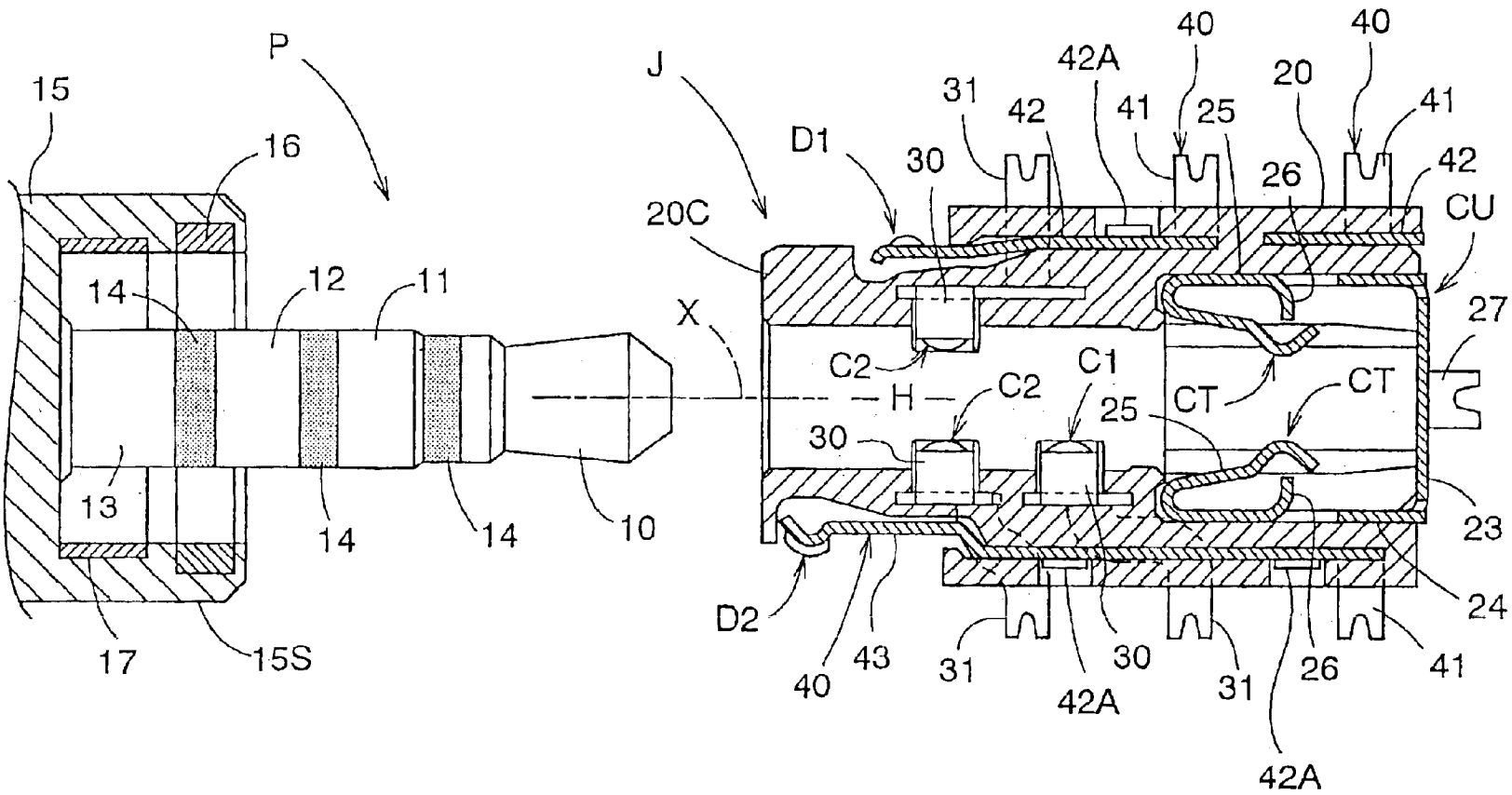
FIG. 9 is a sectional view showing the jack and the plug.

For example a configuration as shown in FIG. 2 and FIG. 9 is conceivable as the plug P. That is to say, the plug P is provided with a tip electrode 10 at the front end of the plug, and, in that order from the front end, first and second ring electrodes 11 and 12 for audio signals, and a third ring electrode 13 for control signals, which are separated by three insulation rings 14. On the inner side of a sleeve 15S that is formed in one piece with a handle portion 15, the plug P is further provided with a cylindrical first sleeve electrode 16 and second sleeve electrode 17 for control purposes. The tip electrode 10, the first and second ring electrodes 11 and 12, and the first and second sleeve electrodes 16 and 17 are all made of a good conductor, such as a copper alloy or the like, with excellent abrasion resistance. Although not shown in the drawings, all of these electrodes are connected to conducting wires within the cable 3.

As shown in FIGS. 2 to 12, the jack J has a block-shaped body 20 made of an insulating resin that is provided with a top surface 20T, a bottom surface 20B, and a plurality of side surfaces 20S. A plurality of contacts (explained below) are provided along a plug insertion hole H that is in continuation with an aperture of a cylindrical portion 20C formed in one piece with one of the side surfaces 20S. Moreover, the inner surface of the cylindrical portion 20C facing the plug insertion hole H is provided with an inner control contact DB contacting the third ring electrode 13, and the outer surface of the cylindrical portion 20C is provided with first and second control contacts D1 and D2 contacting the first and second sleeve electrodes 16 and 17.

Figure 10:
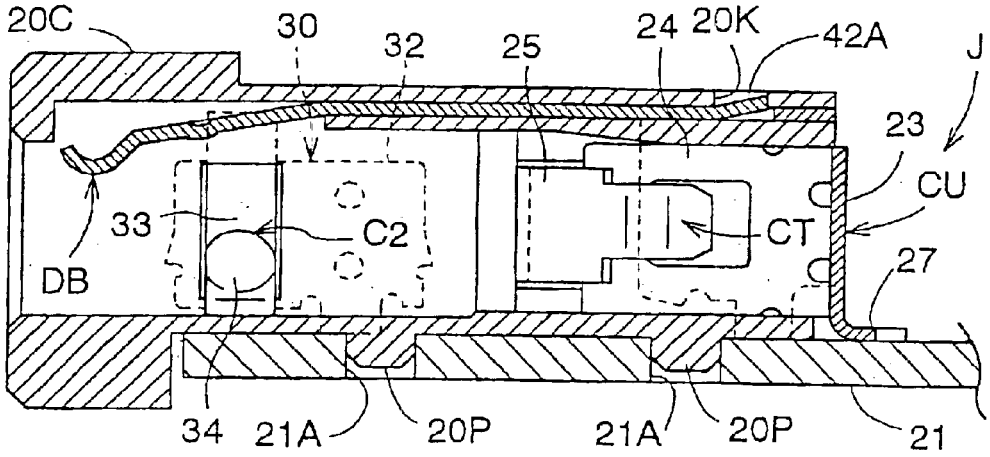
FIG. 10 is cross-sectional view of the jack taken from the side.
Figure 11:
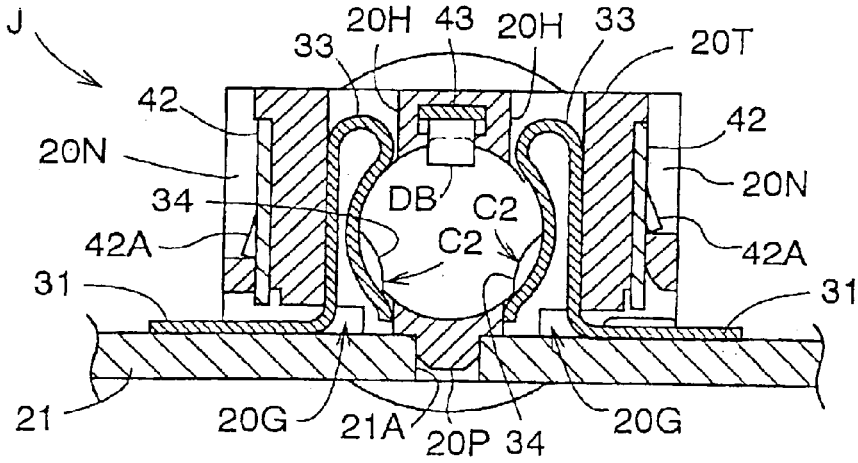
FIG. 11 is cross-sectional view of the jack taken from the front.
Figure 12:
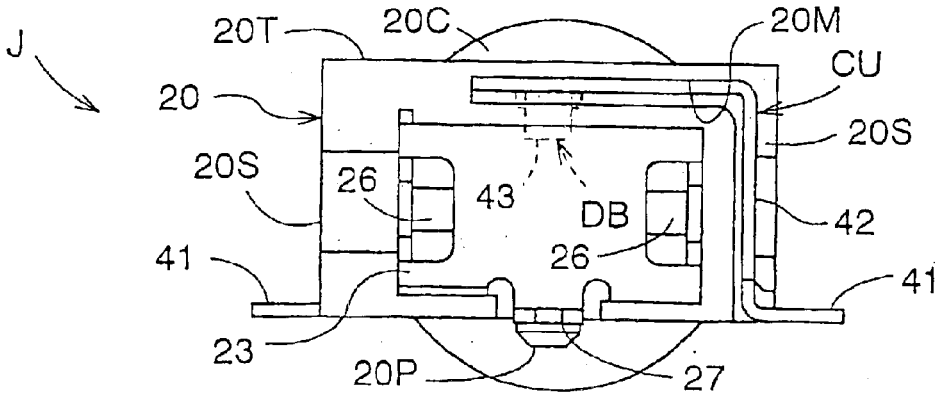
FIG. 12 is a rear view of the jack.

A pair of positioning protrusions 20P protrude from the lower surface 20B of the body 20. When the jack J is mounted on a substrate 21, these positioning protrusions 20P are engaged with holes 21A in the substrate 21, as shown in FIGS. 10 and 11, so that the jack J can be positioned with high precision with respect to the substrate 21. Moreover, the engagement of the protrusions 20P with the holes 21A in the substrate 21 ensures that there is no relative displacement between the substrate 21 and the jack J when the plug P is inserted into or pulled out of the jack J, even when using a large force to do so.

The plurality of contacts are made of a contact unit CU having tip contacts CT that establish a conductive state as they contact the tip electrode 10 at the front end of the plug, and first and second intermediate contacts C1 and C2 that establish a conductive state as they contact the first and the second ring electrodes 11 and 12.

Figure 4:
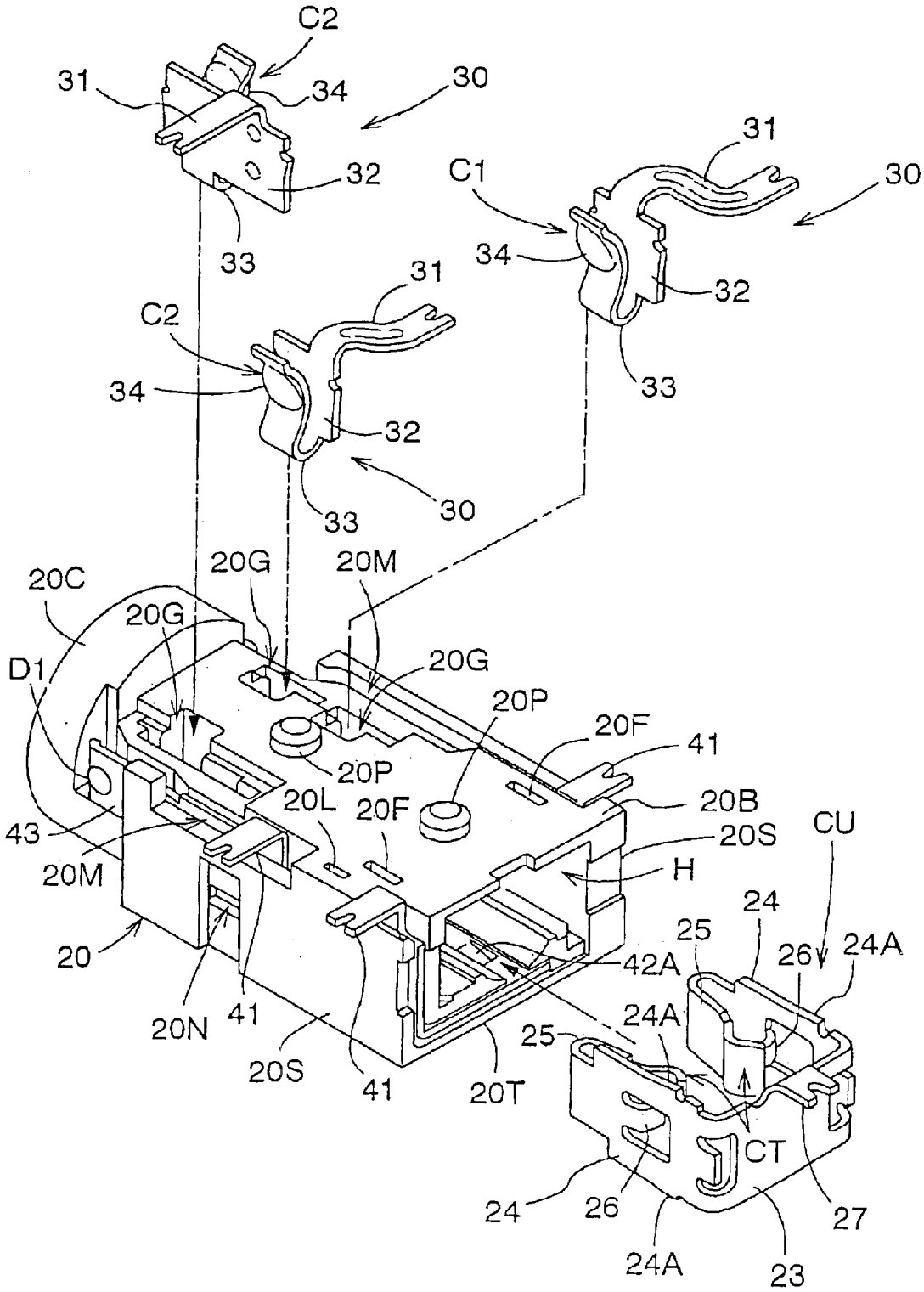
FIG. 4 is an exploded perspective view showing the body, contact members and a contact unit.
Figure 5:
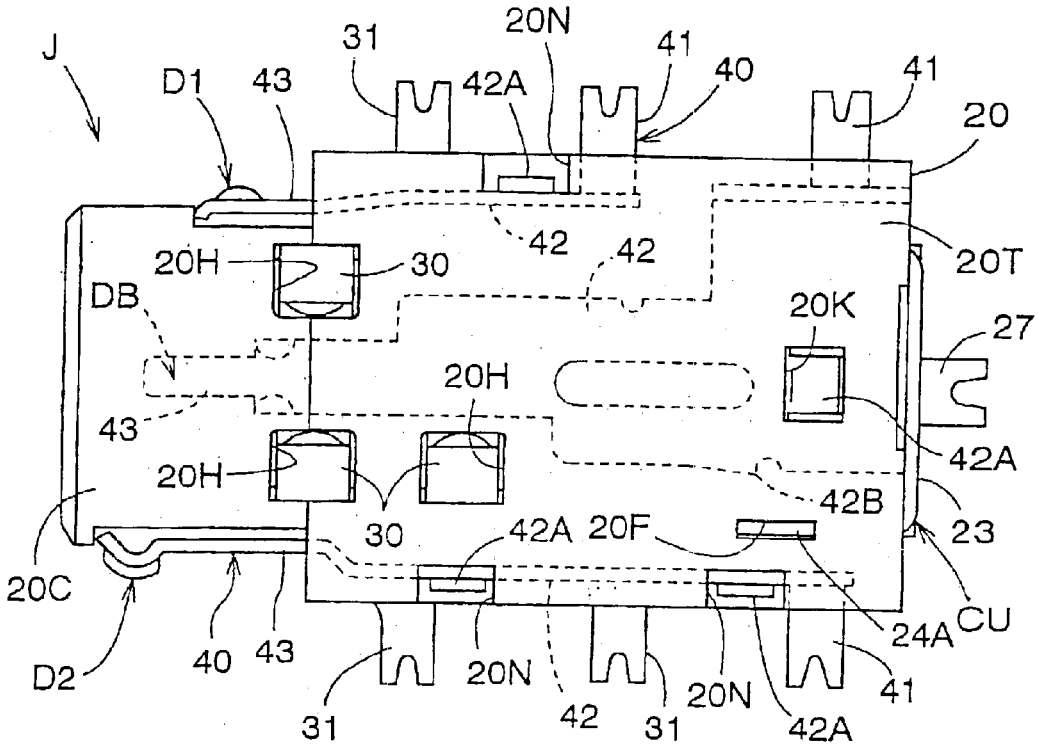
FIG. 5 is a top view of the jack.
Figure 6:
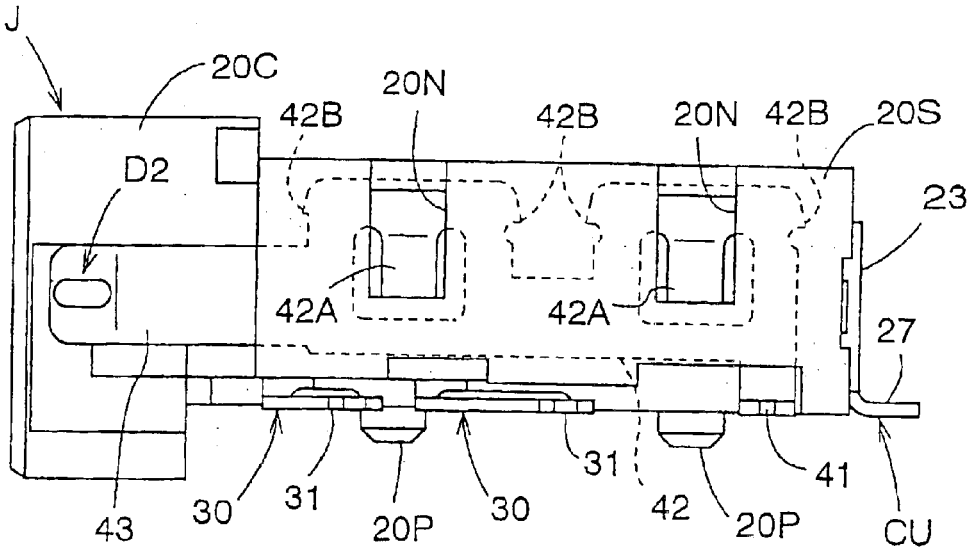
FIG. 6 is a lateral view of the jack.
Figure 7:
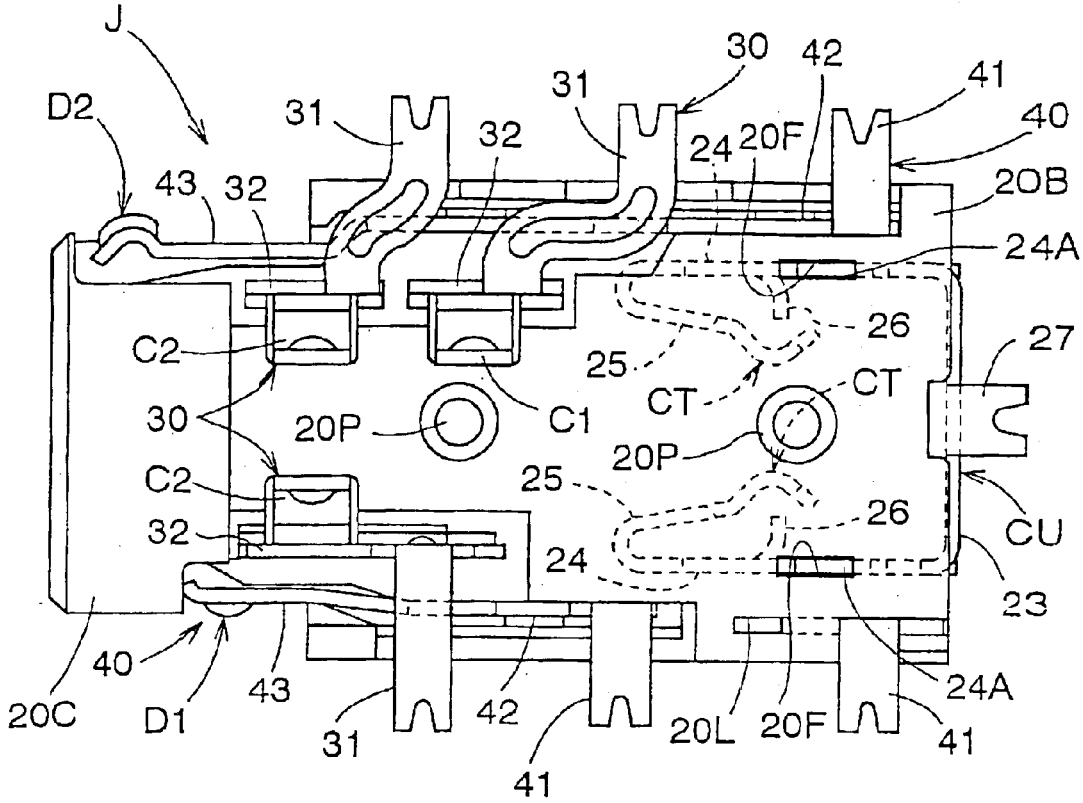
FIG. 7 is a bottom view of the jack.
Figure 8:
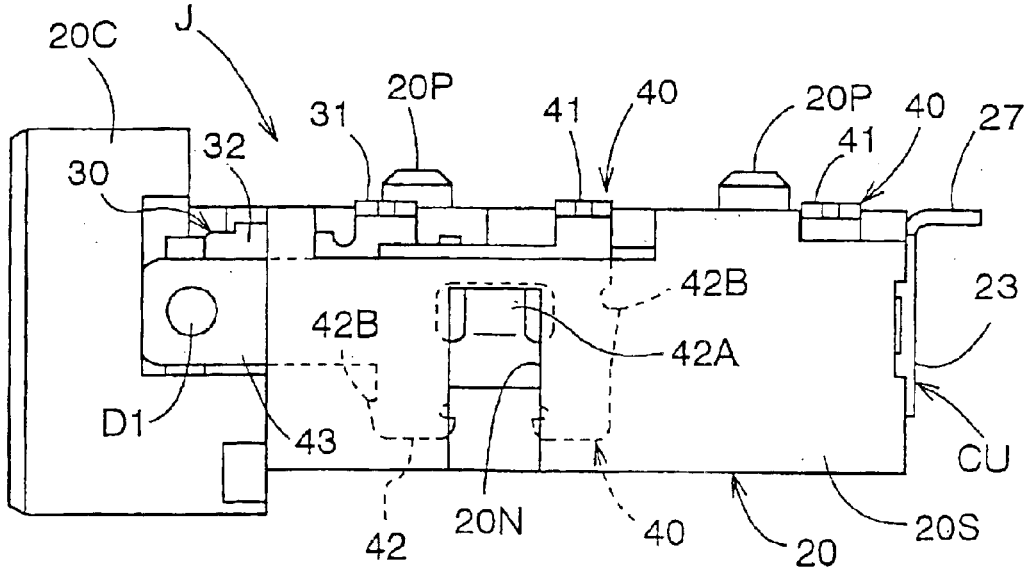
FIG. 8 is a lateral view of the jack.

As shown in FIGS. 4 and 9, the contact unit CU includes a linking portion 23, intermediate portions 24, folded portions 25, and abutting portions 26, formed in one piece by bending a band-shaped good conductor, such as a copper alloy or the like. The linking portion 23 is arranged at the inner end of the plug insertion hole H in an orientation perpendicular to the axis X of the plug insertion hole H (that is, an orientation in which the walls of the linking portion 23 are perpendicular to the axis X). The intermediate portions 24 extend from both ends of the linking portion 23 towards the aperture of the plug insertion hole H (along the axis X of the plug insertion hole H). The folded portions 25 are folded over from the ends of the intermediate portions 24 to the inner side of the plug insertion hole H, projecting into the plug insertion hole H. And the abutting portions 26 project from the intermediate portions 24 toward the folded portions 25. The above-mentioned tip contacts CT are formed on the free end side of the folded portions 25. The tip contacts CT are formed by shaping a curvature, such that they protrude towards the axis of the plug insertion hole H, fitting the small diameter portion of the tip electrode 10 of the plug P. If the tip contacts CT are deformed together with the folded portions 25 in the direction away from the axis X of the plug insertion hole H, then the abutting portions 26 abut against the tip contacts CT and prevent excessive deformation.

In the configuration of this contact unit CU, it is not necessary to let the protruding ends of the abutting portions 26 abut against the tip contacts CT as shown in FIG. 9, and it is possible to let the protruding ends of the abutting portions 26 abut against the folded portions 25.

A terminal 27 is formed in one piece with the linking portion 23 of this contact unit CU, and latch portions 24A are formed unitarily at the edges of the intermediate portion 24. By press-fitting the contact unit CU from an aperture formed at the side surface of the body 20 and located at the side of the inner end of the plug insertion hole H, the latch portions 24A are brought into a state in which they engage the bottom surface 20B of the body 20 and an engaging hole 20F formed in the top surface 20T of the body 20 and are supported in this latched state. When the contact unit CU is supported like this by the body 20, the bottom surface of the terminal 27 of the contact unit CU is arranged in an orientation in which it is located on a virtual plane defined by the bottom surface 20B of the body 20.

The first intermediate contact C1 and the second intermediate contacts C2 are both formed on contact members 30 made by press-forming a good conductor, such a copper alloy or the like.

That is to say, the contact member 30 for the first intermediate contact is provided with a terminal 31, a support portion 32, a curved portion 33, and the first intermediate contact C1. The support portion 32 is linked to the terminal 31 and in vertical orientation in FIG. 4 (that is, oriented in a direction perpendicular to the surface of the substrate 21). The curved portion 33 is linked to the support portion 32 and formed such that it can be elastically deformed. The first intermediate contact C1 is linked to the curved portion 33, and is formed in an arc along the face on the side of the plug. A small protrusion portion 34 is formed on the contact face of this first intermediate contact C1. By inserting the contact members 30 into holes 20G formed at the bottom surface 20B of the body 20, the support portions 32 are brought into press contact with and supported by the inner face of slits formed in continuation with the holes 20G, and at the same time, the curved portion 33 is fitted into an aperture 20H formed in the top surface 20T of the body 20, stabilizing the orientation of the first intermediate contact C1. In this supported state, the bottom surface of the terminal 31 is arranged on a virtual plane defined by the bottom surface 20B of the body 20.

Similarly, the contact members 30 for the second intermediate contact are provided with a terminal 31, a support portion 32, a curved portion 33, and the second intermediate contact C2. The support portion 32 is linked to the terminal 31 and in vertical orientation in FIG. 4 (that is, oriented in a direction perpendicular to the surface of the substrate 21). The curved portion 33 is linked to the support portion 32 and formed such that it can be elastically deformed. The second intermediate contact C2 is linked to the curved portion 33, and is formed in an arc along the face on the side of the plug. For these contact members 30 for the second intermediate contact, members are used that form a symmetrical shape after they have been arranged in opposition at the aperture location of the plug insertion hole H. A small protrusion portion 34 is formed on the contact faces of the second intermediate contacts C2. By inserting the contact members 30 into holes 20G formed at the bottom surface 20B of the body 20, the support portions 32 are brought into press contact with and supported by the inner faces of slits formed in continuation with the holes 20G, and at the same time, the curved portions 33 are fitted into apertures 20H formed in the top surface 20T of the body 20, stabilizing the orientation of the second intermediate contact C2. In this supported state, the bottom surface of the terminal 31 is arranged on a virtual plane defined by the bottom surface 20B of the body 20.

The inner control contact DB, and the first and second control contacts D1 and D2 are formed on control contact members 40 made by press-forming a good conductor, such as a copper alloy or the like, and the control contact members 40 have basically the same structure.

More specifically, the control contact members 40 have a terminal 41, a support portion 42, an arm portion 43, and the inner control contact DB or the first or second control contact D1 or D2. The support portion 42 is linked to the terminal 41 and in vertical orientation in FIG. 3 (that is, oriented in a direction perpendicular to the surface of the substrate 21). The arm portion 43 is linked to the support portion 42 and is elastically deformable. The inner control contact DB, and the first and second control contacts D1 and D2 are linked to the arm portion 43. Furthermore, the respective support portions 42 are formed in one piece with a protruding piece 42A that prevents the control contact member 40 from coming off, and the edges of the respective support portions 42 are formed in one piece with a plurality of checking pieces 42B that prevent the control contact member 40 from coming off.

By inserting the control contact member 40 that is provided with the inner control contact DB into the body 20 from the same direction as the contact unit CU, its support portion 42 is brought into press contact with the inner face of a groove-shaped portion 20M in the body 20, and at the same time, the protrusion piece 42A engages an engaging hole 20K formed in the top surface 20T of the body 20, one of the checking pieces 42B engages an engaging hole 20L in the bottom surface of the body, and the other checking piece 42B engages the inside of the body 20, thereby maintaining the control contact member 40 in its supported state. Furthermore, by inserting the control contact members 40 that are provided with the first and second control contacts D1 and D2 into groove-shaped portions 20M formed in the bottom surface 20B of the body 20, their support portions 42 are brought into press contact with the inner face of a groove-shaped portion 20M in the body 20, and at the same time, their protrusion pieces 42A engage engaging holes 20N formed in the side surfaces 20S of the body 20, and their checking pieces 42B engage the inside of the body 20, thereby maintaining the control contact members 40 in their supported state. When supported in this manner, the inner control contact DB is arranged at the inner surface of the cylindrical portion 20C, as mentioned above, whereas the first and the second control contacts D1 and D2 are arranged at the outer surface of the cylindrical portion 20C. The bottom surfaces of the terminals 41 of the control contact members 40 are positioned on the virtual plane defined by the bottom surface 20B of the body 20.

Figure 3:
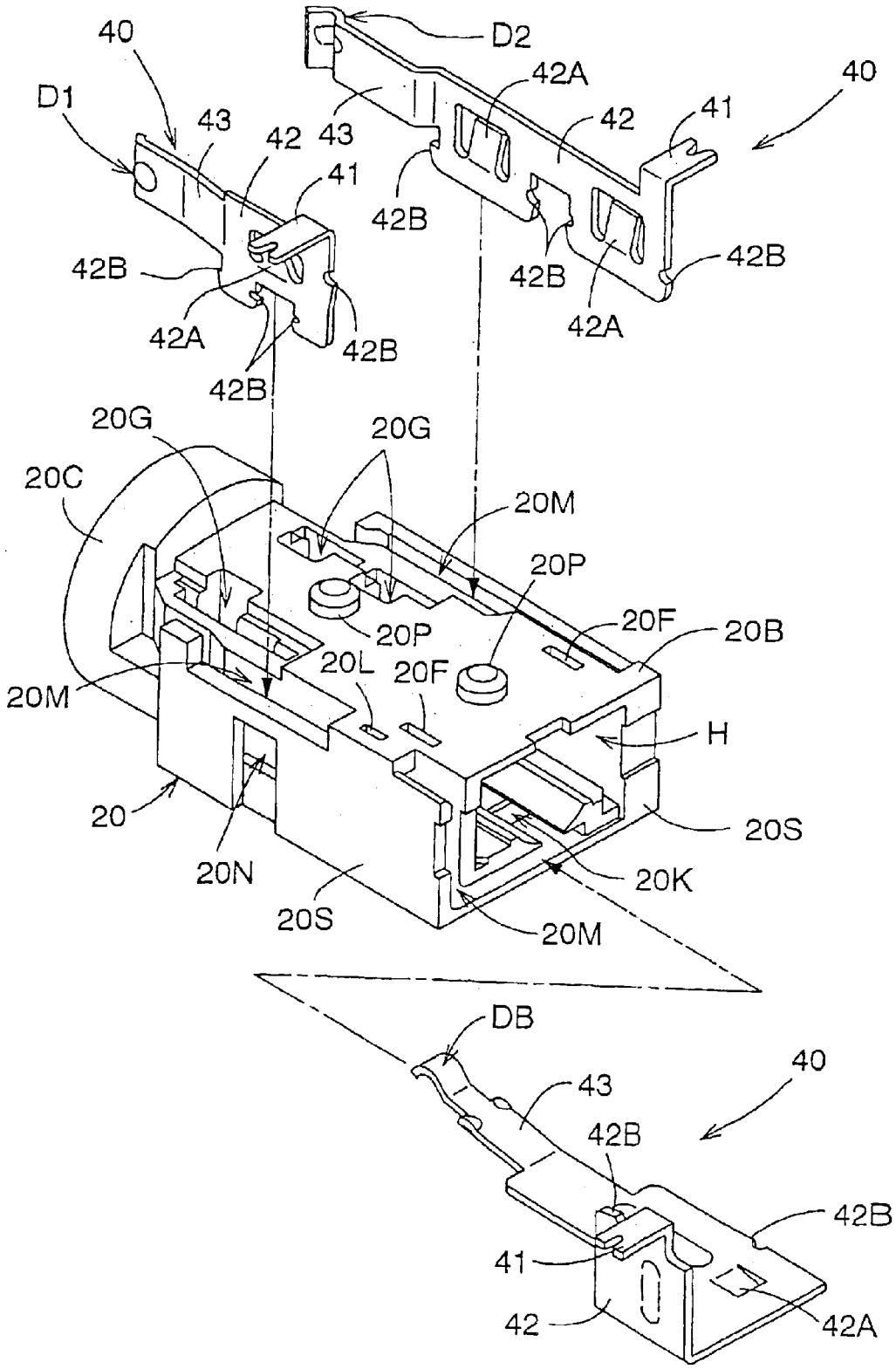
FIG. 3 is an exploded perspective view showing a body and control contact members.

It should be noted that when assembling a jack J with this configuration, first the control contact members 40 provided with the inner control contacts DB and the first and second control contacts D1 and D2 are inserted into the body 20, as shown in FIG. 3, and then the contact unit CU and the contact members 30 having the first intermediate contact C1 and the second intermediate contact C2 are inserted into the body 20, as shown in FIG. 4.

Figure 13A:
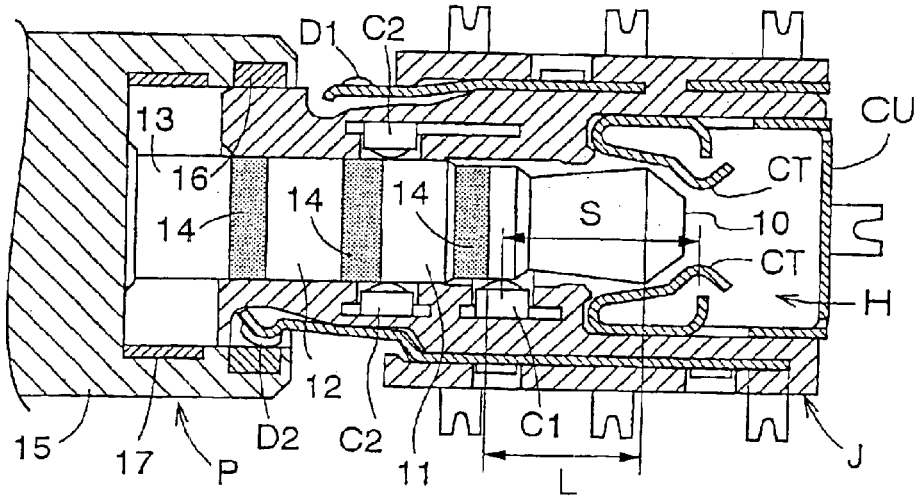
FIG. 13 shows sectional views illustrating the positional relation between the jack and the plug when the plug is inserted into the jack.
Figure 13B:
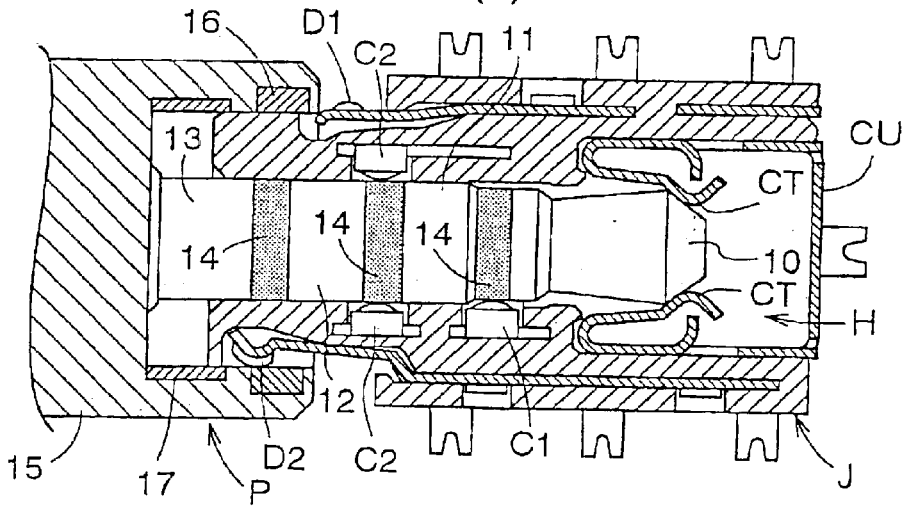
Figure 13C:
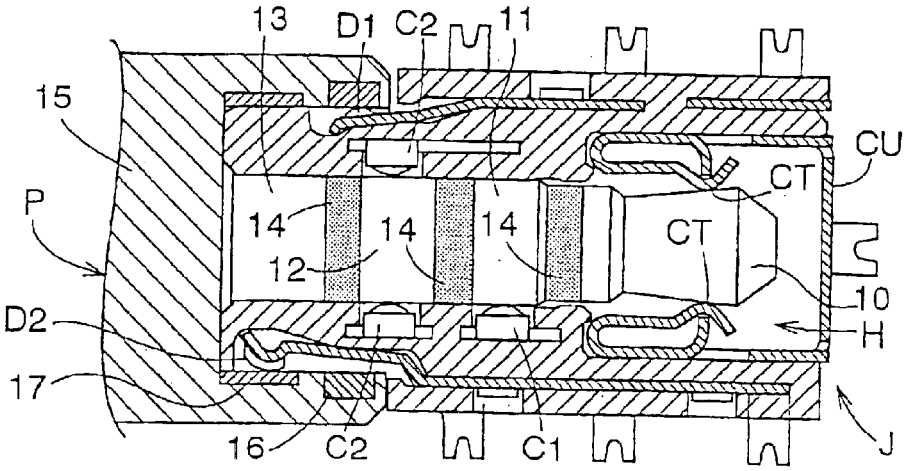

As shown in FIG. 13(*a*), the spacing S in the direction along the plug insertion hole H between the conduction site of the first intermediate contact C1 and the conduction site of the tip contacts CT is set to a value that is smaller than the length L in the direction along the plug axis of the region of the plug's tip electrode 10 at which conduction is possible. It should be noted that this region at which conduction is possible is the region at which conduction becomes possible by contacting the first intermediate contact C1 or the tip contacts CT.

By setting this dimensional relation, if the plug P is inserted into the plug insertion hole H, the tip electrode 10 will not contact the tip contacts CT or the members constituting the contact unit CU in a state in which the first intermediate contact C1 contacts the end on the base end side (side near the insulation ring 14) of the tip electrode 10, as shown in FIG. 13(*a*). And when a state is reached in which the plug P is further inserted into from the position shown in FIG. 13(*a*) and the tip contact CT contacts the tip electrode 10 as shown in FIG. 13(*b*), then the first intermediate contact C1 is separated from the tip electrode 10. Thus, when inserting the plug P into the plug insertion hole H, the first intermediate electrode C1 and the tip contact CT will not simultaneously contact the tip electrode 10, and an unnecessary current due to electrical conduction between the first intermediate electrode C1 and the tip contact CT will not flow, thus avoiding the problem of grating noises being generated in the headphones 4 or the earphones.

After that, as shown in FIG. 13(*c*), when the plug P is inserted completely into the jack J, the pair of tip contacts CT contact the tip electrode 10 in an embracing fashion, the first intermediate contact C1 contacts the first ring electrode 11, the pair of second intermediate contacts C2 contacts the second ring electrode 12 in a clamping fashion, the inner control contact DB contacts the third ring electrode 13, the first control contact D1 contacts the first sleeve electrode 16, and the second control contact D2 contacts the second sleeve electrode 17, thereby enabling the transmission of audio signal and the accessing of control signals.

In accordance with the present invention, when the plug P is inserted into the jack J, the tip electrode 10 at the front end of the plug is embraced by the pair of tip contacts CT formed on the contact unit CU, thus contacting the tip electrode 10 and establishing a conductive state, so that a reliable contact is accomplished regardless of the orientation in which the plug P is inserted. At the same time, due to elastic deformation of the tip contacts CT at the combined region of the intermediate portion 24 and the folded portion 25 of the contact unit CU, the tip contacts CT, there is a contact pressure with respect to the tip electrode 10, so that a favorable elastic spring force can be attained without making the contact unit CU bigger, and as a result, a smaller jack J can be realized. Furthermore, when the plug P has been inserted, the combined region of the intermediate portion 24 and the folded portion 25 is elastically deformed as it comes into contact with the tip electrode 10 as explained above, so that, as opposed to configurations with local elastic deformation, even when the plug P is inserted and pulled out repeatedly, a contact state with a favorable contact pressure is maintained without risking plastic deformation of the intermediate portion 24 and the folded portion 25. For example, even in a situation in which an excessive force is applied to one of the tip contacts CT, such as when the plug P is inserted with force in a direction oblique to the axis X of the plug insertion hole H, the folded portion 25 abuts against the tip contact CT, thereby setting a limit to the deformation, so that the problem of plastic deformation of one of the intermediate portions 24 or folded portions 25 can be avoided.

By setting, as mentioned before, the spacing S in the direction along the plug insertion hole H between the conduction site of the first intermediate contact C1 and the conduction site of the tip contacts CT to a value that is smaller than the length L in the direction along the plug axis of the region of the plug's tip electrode 10 at which conduction is possible, the problem of grating noises being generated in the headphones 4 or the earphones when the plug P is inserted or pulled out can be avoided. Moreover, when the plug P has been inserted, the plug P is clamped by the pair of second intermediate contacts C2 on the side near the aperture of the plug insertion hole H, so that with this configuration, the orientation of the plug P is maintained and the plug P is prevented from coming off.

In particular, this jack J can be assembled by inserting the contact unit CU, the plurality of contact members 30 and the plurality of control contact members 40 into the body 20, so that extraordinary steps such as gluing or caulking are not necessary. Moreover, if the jack J has been mounted to the substrate 21, it can be positioned with high accuracy with respect to the substrate 21, due to the protrusions 20P protruding from the bottom surface 20B. At the same time, a firm mounting state is maintained without changing the position of the jack J with respect to the substrate 21, even if the plug P is inserted or pulled out under application of a large force.

The jack according to the present invention can be applied to jacks for audio devices, such as MD players or CD players, or mobile phones, which can be used for single-prong plugs for connecting stereo earphones or headphones via a cable. Furthermore, it can also be applied to jacks adapted for a single tip electrode and a single ring electrode for monaural audio devices, or it can be applied to jacks adapted for plugs not provided with control electrodes.

What is claimed is:

1. A jack (J) comprising a plurality of contacts along a plug insertion hole (H) formed in a body (20), the contacts including tip contacts (CT) contacting a tip electrode (10) at a front end of a plug (P) that is inserted into the plug insertion hole (H), and intermediate contacts (C1) and (C2) contacts ring electrodes (11) and (12) at intermediate locations of the plug (P), wherein a contact unit (CU) is constituted by a linking portion (23) that is arranged at an inner end of the plug insertion hole (H) in an orientation perpendicular to an axis (X) of the plug insertion hole (H), intermediate portions (24) that extend from both ends of the linking portion (23) towards an aperture side of the plug insert hole (H), and folded portions (25) that are folded over from the aperture side of the intermediate portions (24) to the inner end side of the plug insertion hole (H), projecting into the plug insertion hole (H), the contact unit (CU) being formed in one piece by bending a conductor, and wherein the tip contacts (CT) are formed on a free end side of the folded portions (25) in the contact unit (CU).

2. The jack according to claim 1, wherein the intermediate contacts (C1) and (C2) are arranged at an intermediate location and at a base end position that is located closer to an aperture side of the plug insertion hole (H) than the intermediate location, such that the intermediate contacts (C1) and (C2) contact the two ring electrodes (11) and (12) formed at intermediate locations of the plug (P), and wherein the intermediate contacts (C2) at the base end location are configured as a pair, arranged in opposition at locations clamping the ring electrode (12).

3. The jack according to claim 1, wherein the contact unit (CU) is provided with abutting portions (26) protruding toward the folded portions (25) or toward the tip contacts (CT), the abutting portions (26) being formed in one piece with the intermediate portions (24), and wherein when the folded portions (25) are elastically deformed more than a predetermined amount, the abutting portions (26) are abutted and deformation of the folded portions (25) is prevented.

4. The jack according to claim 3, wherein the intermediate contacts (C1) and (C2 ) are arranged at an intermediate location and at a base end position that is located closer to an aperture side of the plug insertion hole (H) than the intermediate location, such that the intermediate contacts (C1) and (C2 ) contact the two ring electrodes (11 ) and (12 ) formed at intermediate locations of the plug (P), and wherein the intermediate contacts (C2 ) at the base end location are configured as a pair, arranged in opposition at locations clamping the ring electrode (12).

5. The jack according to claim 1, wherein a spacing (S) in a direction along the plug insertion hole (H) between a conduction side of the intermediate contacts (C1), (C2) and a conduction side of the tip contacts (CT) is set to a value that is smaller than a length (L) in a direction along the plug axis of a region of the plug (P)'s tip electrode (10) at which conduction to said contacts is possible.

6. The jack according to claim 5, wherein the intermediate contacts (C1) and (C2) are arranged at an intermediate location and at a base end position that is located closer to an aperture side of the plug insertion hole (H) than the intermediate location, such that the intermediate contacts (C1) and (C2) contact the two ring electrodes (11) and (12) formed at intermediate locations of the plug (P), and wherein the intermediate contacts (C2) at the base end location are configured as a pair, arranged in opposition at locations clamping the ring electrode (12).

* * * * *

UNITED STATES PATENT AND TRADEMARK OFFICE

CERTIFICATE OF CORRECTION

PATENT NO. : 6,869,315 B2
DATED : March 22, 2005
INVENTOR(S) : Nakai et al.

It is certified that error appears in the above-identified patent and that said Letters Patent is hereby corrected as shown below:

Title page,
Item [56], References Cited, add the following:
-- FOREIGN PATENT DOCUMENTS

| | | | |
|---|---|---|---|
| JP | JP 2000-340311 | Mitsumi Electric Co Ltd. | 12/2000 |
| JP | JP 2001-217053 | Hosiden Corp. | 08/2001 |
| JP | JP 2001-230029 | Hosiden Corp. | 08/2001 |
| JP | JP 64-063283 | Matsushita Elkectric Ind Co Ltd. | 03/1989 --; |

and add the following:
-- OTHER PUBLICATIONS
Partial translation of Japanese Utility Model Application "Kokoku" No.: Hei. 2-12695 (April 10, 1990)
Partial translation of Japanese Utility Model Application "Kokoku" No.: Hei. 3-38777 (August 15, 1991) --.
Item [86], PCT No. PCT/JP03/04756
§ 371 (c)(1),
(2), (4) Date: delete "Oct. 23, 2003" and insert in its place -- September 11, 2003 --.

Column 7,
Line 38, "spacing S" should read -- spacing L --.
Line 41, "value that is smaller" should read -- value that is larger --.
Line 42, "length L" should read -- length S --.

Column 8,
Line 40, "spacing S" should read -- spacing L --.
Line 44, "smaller than the length L" should read -- larger than the length S --.

UNITED STATES PATENT AND TRADEMARK OFFICE

CERTIFICATE OF CORRECTION

PATENT NO. : 6,869,315 B2
DATED : March 22, 2005
INVENTOR(S) : Nakai et al.

It is certified that error appears in the above-identified patent and that said Letters Patent is hereby corrected as shown below:

Column 10,
Line 20, "spacing (S)" should read -- spacing (L) --.
Line 24, "smaller than a length (L)" should read -- larger than a length (S) --.

Signed and Sealed this

First Day of November, 2005

JON W. DUDAS
*Director of the United States Patent and Trademark Office*